US006053773A

United States Patent [19]

Wu

[11] Patent Number: 6,053,773

[45] Date of Patent: Apr. 25, 2000

[54] ELECTRICAL INPUT/OUTPUT CONNECTOR

[75] Inventor: Kun-Tsan Wu, Tu-Chen, Taiwan

[73] Assignee: Hon Hai Precision Ind. Co., Ltd., Taipei Hsien, Taiwan

[21] Appl. No.: 09/119,474

[22] Filed: Jul. 20, 1998

[30] Foreign Application Priority Data

Aug. 26, 1997 [TW] Taiwan ..... 86214676

[51] Int. Cl.[7] ..... H01R 13/648

[52] U.S. Cl. ..... 439/609; 439/541.5

[58] Field of Search ..... 439/607–610, 439/79, 329, 541.5, 567, 701

[56] References Cited

U.S. PATENT DOCUMENTS 5,688,145 11/1997 Liu ..... 439/607

5,876,248 3/1999 Brunker et al. ..... 439/660 X

*Primary Examiner*—Khiem Nguyen

[57] ABSTRACT

A USB receptacle connector includes a dielectric housing having a rear wall and an inner space. A plate extends from the rear wall through the inner space to an outside of the housing. The plate defines a number of horizontal contact passageways. The rear wall defines a number of vertical contact passageways in communication with the horizontal contact passageways. Two slots are defined from two lateral sides of the rear wall to the inner space of the housing. A number of contacts having contact portions and tail portions are interferentially received in the corresponding horizontal and vertical contact passageways. A front metal shielding has a rear part received in the inner space of the housing, and two side walls having rear portions extending into the slots to fixedly engage with the housing. The front shielding member covers the contact portions of the contacts. A rear shielding member has two side walls defining two engaging ridges extending into the slots to be fittingly received in two slits defined in the rear portions of the two side walls of the front shielding member. The rear shielding member covers the tail portions of the contacts.

20 Claims, 7 Drawing Sheets

ELECTRICAL INPUT/OUTPUT CONNECTOR

BACKGROUND OF THE INVENTION

1. Field of the Invention

The present invention relates to an electrical input/output connector, and particularly to a Universal Serial Bus (USB) receptacle connector having a metal EMI/RFI shielding disposed in a dielectric housing of the connector.

2. The Prior Art

An electrical input/output connector is used to connect a peripheral device (for example, a printer, keyboard or mouse) to a computer. To protect the electrical signal transmission within the connector from electromagnetic interference/radio frequency interference, a metal shielding is used to cover a housing of the connector. Such a connector is disclosed in Taiwan Patent Application Nos. 77208107, 84213585, 85210940 and 85210941. These prior art connectors have a disadvantage in that they require a large metal shielding to cover the housing. Obviously, metal is more expensive than the plastic which forms the housing.

In addition, the shielding for a single connector cannot be used in a stacked connector assembly which may include two or more connectors.

Hence, an improved I/O connector is needed to eliminate the above mentioned defects of current I/O connectors.

SUMMARY OF THE INVENTION

Accordingly, an objective of the present invention is to provide an I/O connector, particularly a USB receptacle connector which has a metal shielding substantially received in a dielectric housing thereof.

Another objective of the present invention is to provide a metal shielding member which can be commonly used in both a single connector and a stacked connector assembly to reduce manufacturing and inventory costs thereof.

To fulfill the above mentioned objectives, according to one embodiment of the present invention, an I/O connector, particularly a USB receptacle connector, consists of a rectangular housing having upper, lower, rear and two side walls cooperatively defining an inner space therebetween. A plate horizontally extends from the rear wall through the inner space to an outside of the housing and defines a number of horizontal contact passageways in a lower face thereof. The rear wall defines a number of vertical contact passageways in communication with the horizontal contact passageways. Two slots are defined in the rear wall. A number of contacts each having a contact portion and a tail portion perpendicular to the contact portion are interferentially fitted in the corresponding horizontal and vertical contact passageways. A front shielding member has a rear part received in the inner space of the housing and two side walls with rear portions extending into the slots to fixedly engage with the housing. A rear shielding member has two side walls extending into the two slots via a rear face of the rear wall. Each side wall of the rear shielding member forms a locking ridge thereon which retentively extends through a slit formed in the rear portion of the corresponding side wall of the front shielding member. The front and rear shielding members cooperatively shield the contacts.

According to another embodiment of the present invention, an I/O connector assembly, particularly a USB receptacle connector assembly, includes a dielectric housing composed of a number of units each having upper, lower, rear and two side walls cooperatively defining an inner space therebetween. A plate horizontally extends from the rear wall through the inner space to an outside of the housing and defines a number of horizontal contact passageways in a lower face thereof. The rear wall defines a number of vertical contact passageways in communication with the horizontal contact passageways. Two slots are defined in the rear wall. A number of contacts each having a contact portion and a tail portion perpendicular to the contact portion are interferentially fitted in the corresponding horizontal and vertical contact passageways. A number of front shielding members each have a structure the same as the first embodiment. Each front shielding member has a rear part received in the inner space of a corresponding unit of the housing and two side walls with rear portions extending into two corresponding slots to fixedly engage with the housing. A rear shielding member has two side walls defining a number of pairs of front arms which extend into two slots via a rear face of the rear wall of the corresponding unit of the housing. Each arm forms a locking ridge thereon which retentively extends through a slit formed in the rear portion of the side wall of the corresponding front shielding member. The front and rear shielding members cooperatively shield the contacts.

DETAILED DESCRIPTION OF THE PREFERRED EMBODIMENT

Reference will now be made in detail to the preferred embodiments of the present invention.

Figure 1:
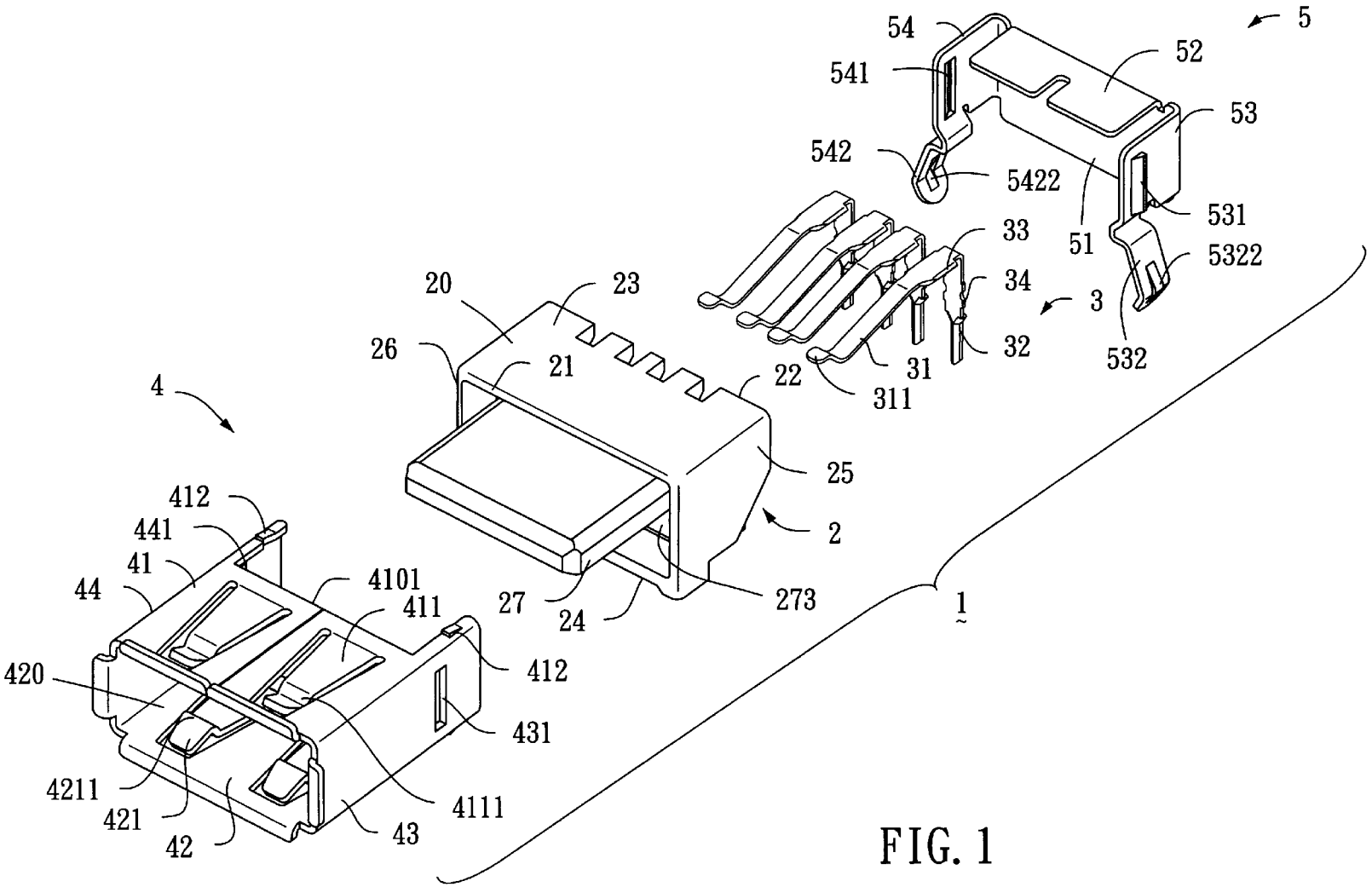
FIG. 1 is an exploded, perspective view of a USB receptacle connector in accordance with a first embodiment of the present invention.
Figure 2:
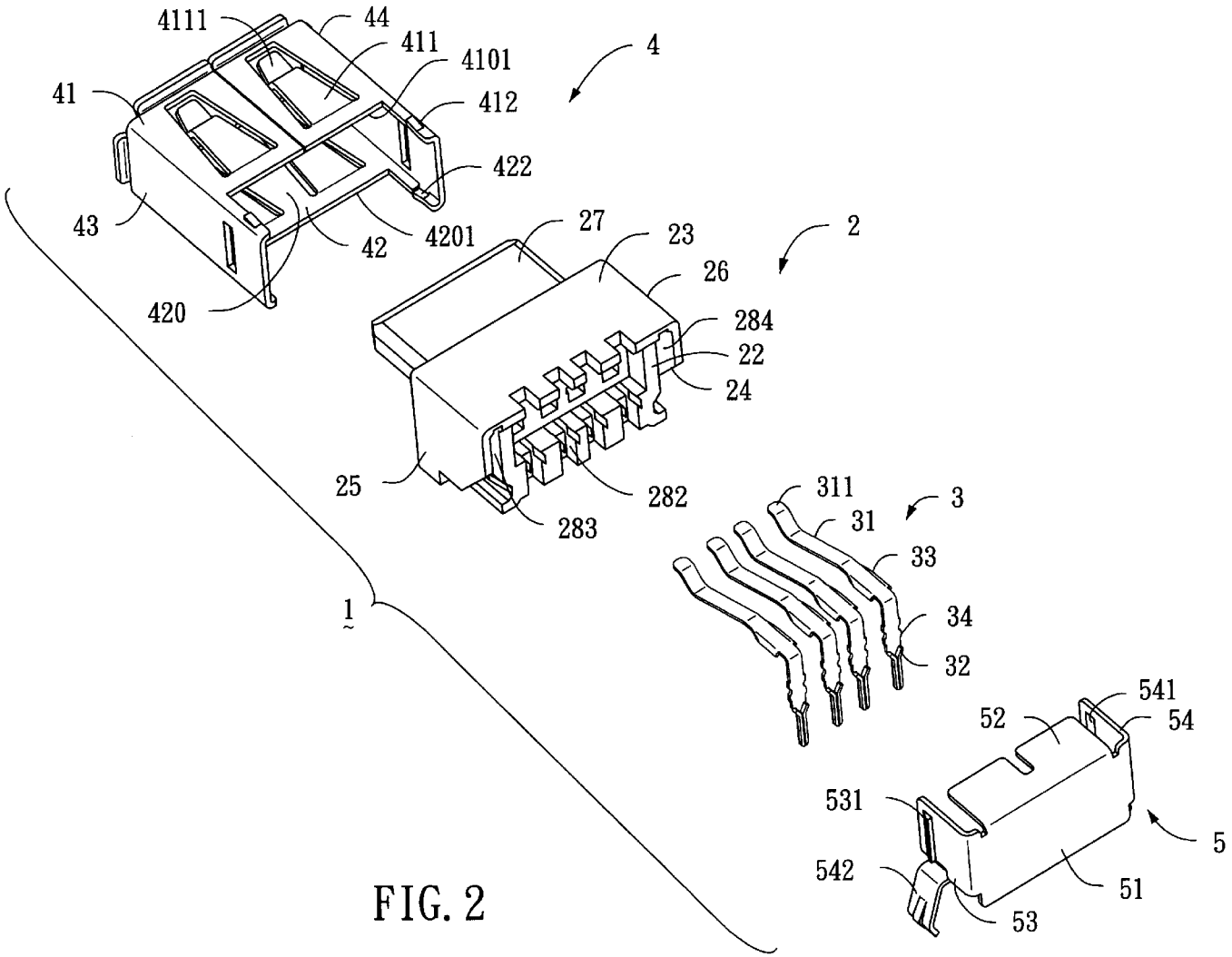
FIG. 2 is a view similar to FIG. 1 as viewed from a different direction.
Figure 3:
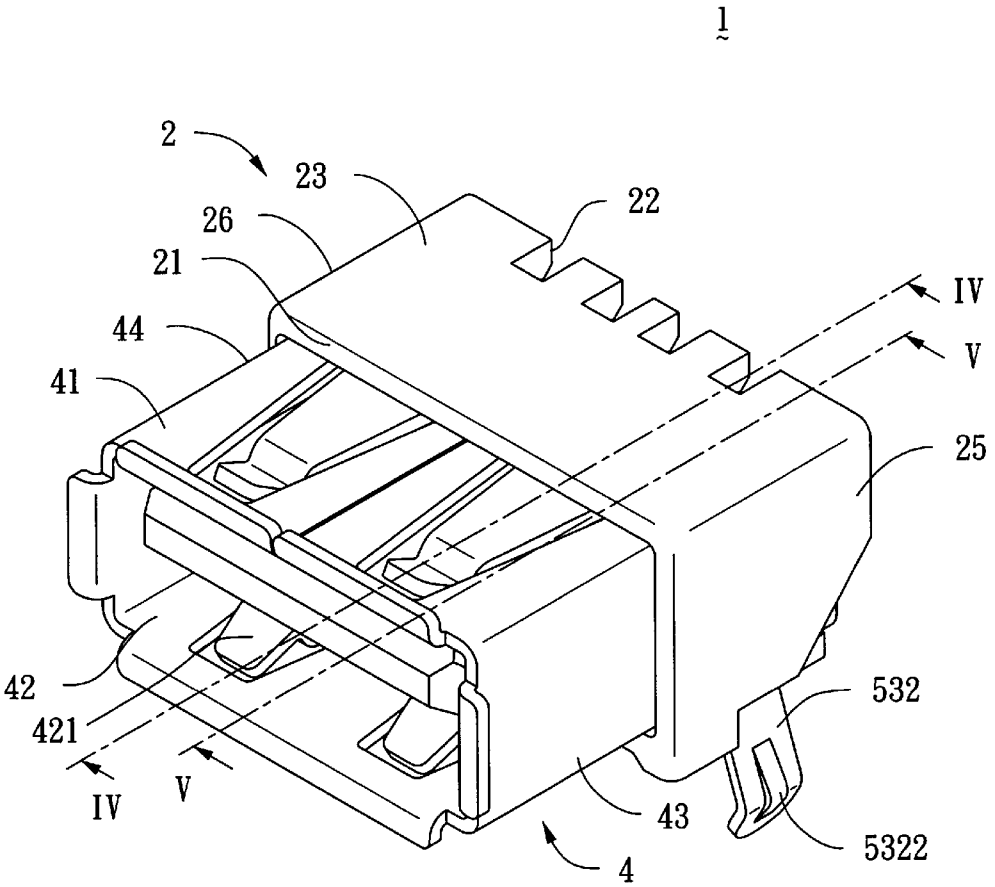
FIG. 3 is a perspective, assembled view of the connector of FIG. 1.

Referring to FIGS. 1 and 2, a USB receptacle connector 1 includes a front shielding member 4, a dielectric housing 2, a number of contacts 3, and a rear shielding member 5. The front shielding member 4 is formed by stamping a metal sheet to have a generally rectangular configuration with an upper wall 41, a bottom wall 42, a right wall 43 and a left wall 44. These walls cooperatively define an inner space 420 therebetween. Each of the right and left walls 43, 44 has a rear portion (not labeled) extending beyond rear edges 4101, 4201 of the upper and bottom walls 41, 42, respectively. The rear portions of the right and left walls 43, 44 each define a slit 431 and form an upper retention tooth 412 and a bottom retention tooth 422. The upper and bottom walls 41, 42 form two plug retention tabs 411, 421, respectively. The plug retention tabs 411, 421 have plug engaging ends 4111, 4211 projecting into the space 420 to engage with a shielding of a mated plug connector (not shown) inserted into the receptacle connector 1.

The dielectric housing 2 is formed by plastic injection molding to have a rectangular body 20 with a top wall 23, a bottom wall 24 and two side walls 25, 26 cooperatively defining a front face 21 for proximity to the mated plug connector. A rear wall 22 is located between the upper, bottom and side walls 23, 24, 25, 26 and cooperates therewith to define an inner space 273. A plate 27 projects forward from the rear wall 22 through the inner space 273 to an outside of the housing 2. The bottom wall 24 is proximate to a printed circuit board (PCB, not shown) on which the connector 1 is mounted. As best seen in FIG. 2, the rear wall 22 of the housing 2 further defines two slots 283, 284 communicating with the inner space 273 of the housing 2, and four vertical contact passageways 282 between the two slots 283, 284 and in communication with corresponding horizontal contact passageways 271 (FIG. 4) defined in a lower face (not labeled) of the plate 27. Each of the slots 283, 284 defines an upper step 231 in the upper wall 23, and a lower step 241 in the lower wall 24 (FIG. 5).

Each contact 3 is formed to have a generally L-shaped configuration with a contact portion 31 for electrically connecting with the mated plug connector, and a tail portion 32 for being soldered to the PCB. The contact portion 31 has a front free end 311 and a first rear fitting portion 33. The tail portion 32 has a second fitting portion 34.

The rear shielding member 5 is made by stamping a metal sheet to have a rectangular plate-shaped body 51, an upper wall 52 extending forward from a top edge of the body 51 and two side walls 53, 54 extending forward from lateral sides of the body 51. The side walls 53, 54 form locking ridges 531, 541 near front ends thereof. Two board locks 532, 542 extend downward from bottom edges of the side walls 53, 54 for interferentially extending through the PCB to fix the connector 1 thereto. Each of the board locks 532, 542 forms a side protrusion 5322, 5422 for enhancing the retentive effectiveness between the board locks 532, 542 and the PCB.

Figure 4:
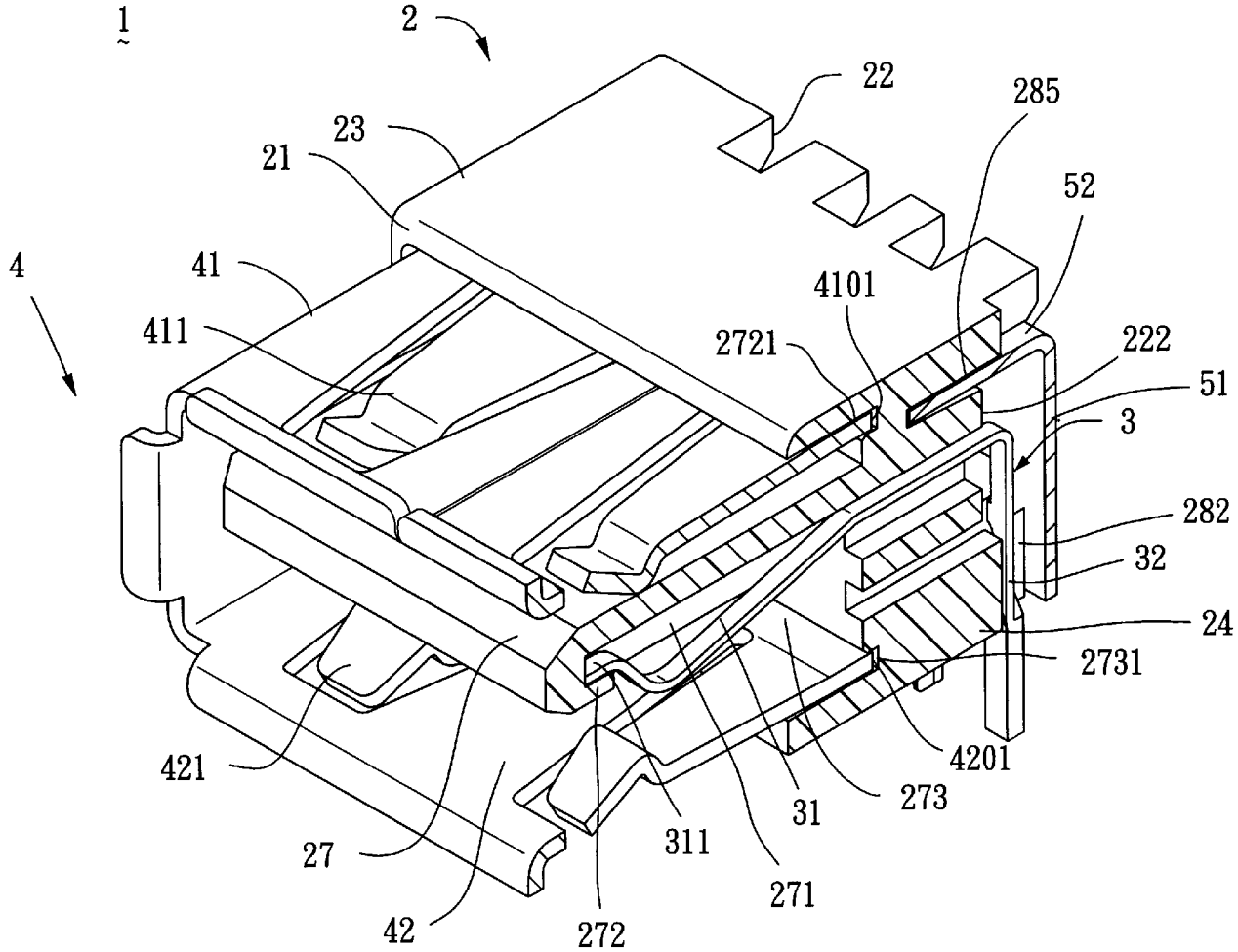
FIG. 4 is a perspective cross-sectional view taken along line IV—IV of FIG. 3.
Figure 5:
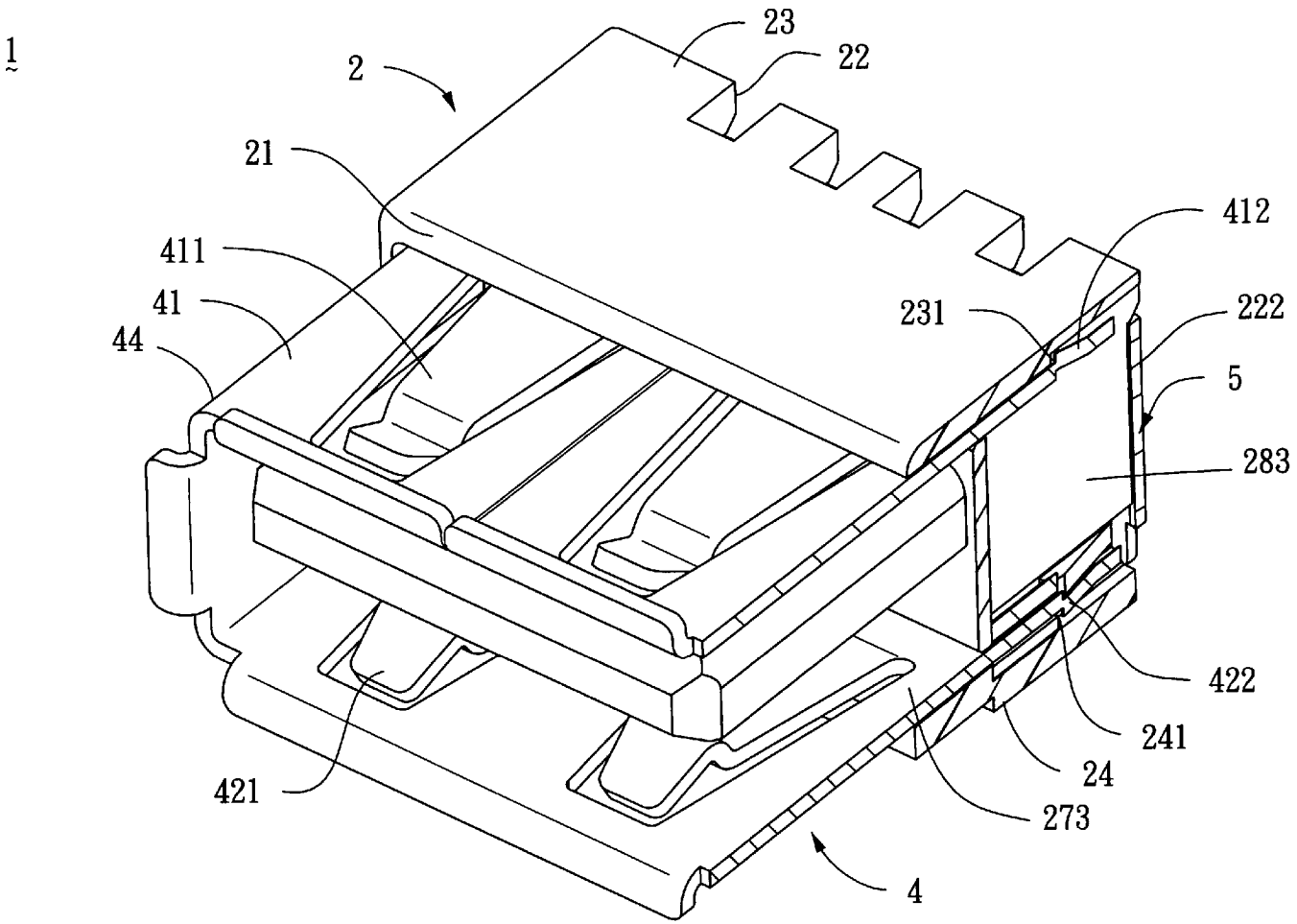
FIG. 5 is a perspective cross-sectional view taken along line V—V of FIG. 3.

Furthermore, referring to FIGS. 4 and 5, to assemble the connector 1, the contacts 3 are firstly mounted into the housing 2 to reach a position as seen in FIG. 4, wherein the contact portions 31 thereof are received in the horizontal contact passageways 271 and the tail portions 32 thereof are received in the vertically contact passageways 282, respectively. The free ends 311 of the contact portions 31 engage with a flange 272 formed on a lower part of a front end of the plate 27, and the first and second fitting portions 33, 34 interferentially engage with the housing 2. A lower end of each tail portion 32 extends beyond the bottom wall 24 of the housing 2.

Thereafter, the front shielding member 4 is mounted to the housing 2 by extending the rear portions of the side walls 43, 44 into the inner space 273 and then the slots 283, 284 to reach a position wherein the upper teeth 412 engage with the upper steps 231 and the lower teeth 422 engage with the lower steps 241 whereby the front shielding member 4 is fixed to the housing 2. The rear edges 4101, 4201 of the upper and lower walls 41, 42 are fittingly received in upper and lower recesses 2721, 2731 in the inner space 273, respectively.

Afterwards, the rear shielding member 5 is mounted to the housing 2 by extending the two side walls 53, 54 thereof into the slots 283, 284 from a rear face 222 of the rear wall 22 to reach a position wherein the upper wall 52 of the rear shielding member 5 is fittingly received in an upper recess 285 exposed to the rear face 222 of the rear wall 22, the locking ridges 531, 541 are fixedly fitted into the slits 431, 441 (although not shown in the drawings, this can be easily understood by those skilled in the art), and the body 51 covers the tail portions 32 of the contacts 3.

In the present invention, as the shielding members 4, 5 have a smaller dimension than that of the housing 2, the required material for constructing the shielding for the present invention can be reduced in comparison with the prior art which have the shielding surrounding the housing.

Figure 6:
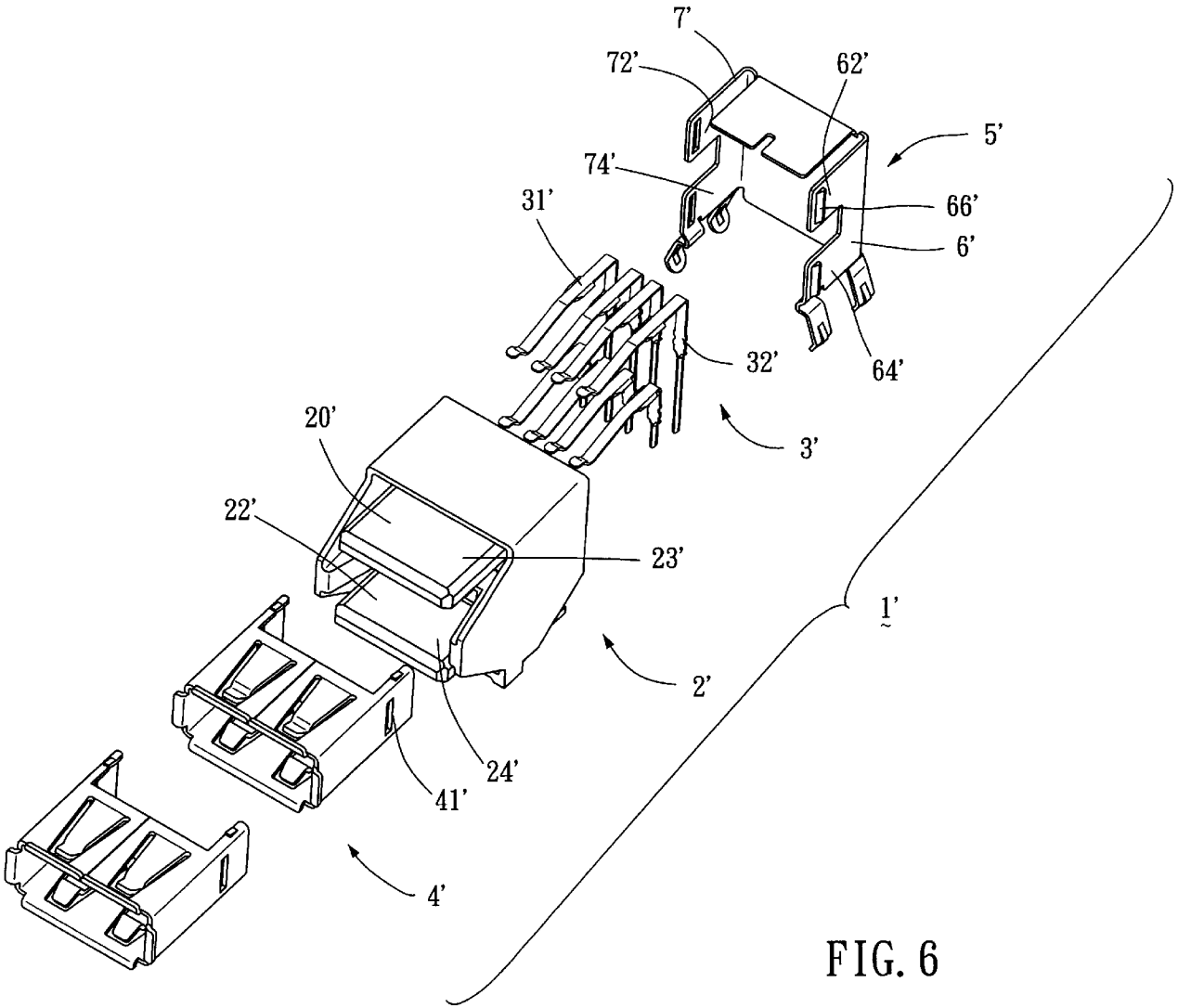
FIG. 6 is an exploded, perspective view of a USB receptacle connector in accordance with a second embodiment of the present invention.
Figure 7:
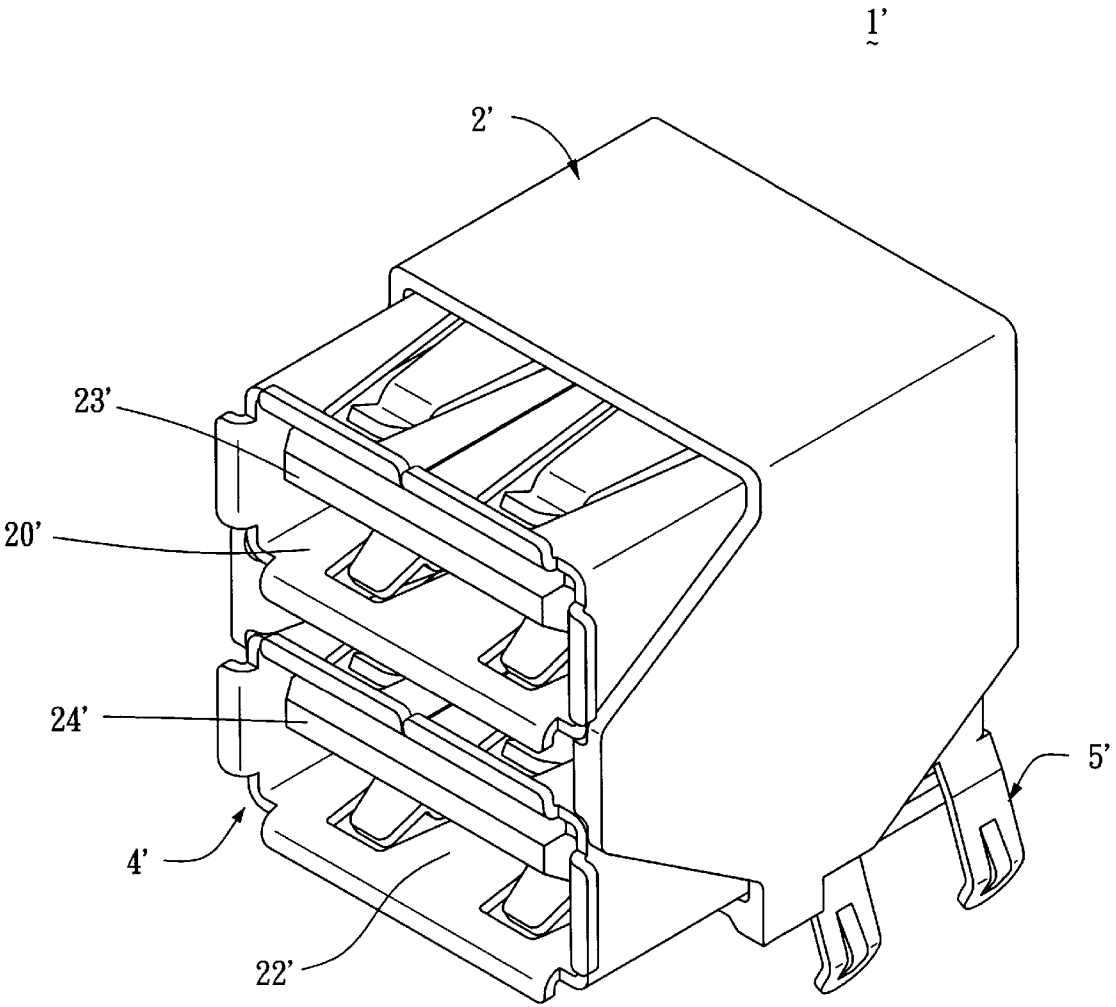
FIG. 7 is a perspective, assembled view of the connector of ig. 6.

Referring to FIGS. 6 and 7, in a second embodiment of the present invention, a connector assembly 1' includes a housing 2' formed to have an upper and lower unit 20', 22' each having a structure substantially the same as that of the housing 2 of the first embodiment so that detailed descriptions of the structure of the units 20', 22' are omitted herein. The connector assembly 1' of the second embodiment includes two receptacle connectors for mating with two plug connectors. To assemble the connector assembly 1', two sets of contacts 3' are successively mounted into the housing 2' to reach a position in which horizontal contact portions 31' of the contacts 3' are received in horizontal contact passageways (not shown) in plates 23', 34' projecting from the housing 2', and tail portions 32' of the contacts 3' are received in vertical contact passageways (not shown) in a rear face (not shown) of the housing 2'. Then, two front shielding members 4' each having a structure identical to that of the front shielding member 2 of the first embodiment are successively mounted to the housing 2'. Finally, a rear shielding member 5' formed with two side walls 6', 7' is mounted to the housing 2'. The side walls 6', 7' are formed with two pairs of front arms 62', 72' and 64', 74' each formed with a locking ridge 66' thereon. When the rear shielding member 5' is mounted to the housing 2', the ridges 66' are fixedly received in slits 41' defined in side walls of the front shielding members 4'.

In the present invention, the front shielding member 2 of the first embodiment can also be used in the second embodiment which is a stacked connector assembly consisting of two receptacle connectors, whereby manufacturing and inventory costs of the connector assembly can be reduced.

While the present invention has been described with reference to a specific embodiment, the description is illustrative of the invention and is not to be construed as limiting the invention. Various modifications to the present invention can be made to the preferred embodiment by those skilled in the art without departing from the true spirit and scope of the invention as defined by the appended claims.

I claim:

1. An electrical connector, comprising:

A substantially rectangular dielectric housing, comprising an upper wall, a lower wall for proximity to a printed circuit board, two side walls between the upper and lower walls and cooperating therewith to define a front face for connecting with a mated connector, a rear wall between the upper, lower and side walls and cooperating therewith to define an inner space, and a plate extending from the rear wall through the inner space to an outside of the housing and defining a number of horizontal contact passageways in a lower face thereof, said rear wall defining a number of vertical contact passageways in a rear face thereof and in communication with the horizontal contact passageways, and two slots defined from two lateral sides of the rear face to the inner space;

a number of contacts each having a contact portion received in a corresponding horizontal contact passageway for electrically connecting with a mated connector and a tail portion received in a corresponding vertical contact passageway for being soldered to the printed circuit board;

a front shielding member having a rear part received in the inner space and two side walls each having a rear portion extending into the corresponding slot to fixedly engage with the housing, said front shielding member covering the contact portions of the contacts; and a rear shielding member comprising two side walls extending into the slots to fixedly connect with the rear portions of the side walls of the front shielding member and cover the tail portions of the contacts.

2. The electrical connector in accordance with claim 1, wherein the rear portion of each side wall of the front shielding member forms an upper and lower tooth fixedly engaging with steps defined in the corresponding slot of the housing.

3. The electrical connector in accordance with claim 1, wherein the rear portion of each side wall of the front shielding member forms a slit therein, each side wall of the rear shielding member defining a locking ridge fittingly received in the corresponding slit.

4. The electrical connector in accordance with claim 1, wherein the front shielding member has an upper and lower wall between the two side walls thereof, each of the upper and lower walls forming a plug retention tab therein.

5. The electrical connector in accordance with claim 4, wherein each of the upper and lower walls of the front shielding member has a rear edge extending into a recess defined by the housing in the internal space.

6. The electrical connector in accordance with claim 1, wherein the side walls of the rear shielding member form board locks extending downwards therefrom.

7. The electrical connector in accordance with claim 6, wherein each board lock forms a side protrusion.

8. The electrical connector in accordance with claim 1, wherein the rear shielding member comprises an upper wall having a front edge fittingly extending into a recess in the rear face of the rear wall.

9. An electrical connector assembly, comprising:

a substantially rectangular dielectric housing composed of a number of stacked units each having a structure substantially the same as each other, each unit comprising an upper wall, a lower wall, two side walls between the upper and lower walls and cooperating therewith to define a front face for connecting with a mated connector, a rear wall between the upper, lower and side walls and cooperating therewith to define an inner space, and a plate extending from the rear wall through the inner space to an outside of the housing and defining a number of horizontal contact passageways in a lower face thereof, said rear wall defining a number of vertical contact passageways in a rear face thereof and in communication with the horizontal contact passageways, and two slots defined from two lateral sides of the rear face to the inner space;

a number of contacts each having a contact portion received in a corresponding horizontal contact passageway for electrically connecting with a mated connector, and a tail portion received in a corresponding vertical contact passageway for being soldered to a printed circuit board;

a number of front shielding members each having a structure the same as each other, each front shielding member having a rear part received in a corresponding inner space and two side walls each having a rear portion extending into the corresponding slot to fixedly engage with the housing; and a rear shielding member fixed to the rear faces of the rear walls of the units of the housing, comprising two side walls forming a number of pairs of front arms extending into the corresponding slots to fixedly connect with the rear portions of the side walls of the front shielding members.

10. The electrical connector assembly in accordance with claim 9, wherein the rear portion of each side wall of each front shielding member forms an upper and lower tooth fixedly engaging with steps defined in the corresponding slot by the corresponding unit of the housing.

11. The electrical connector assembly in accordance with claim 9, wherein the rear portion of each side wall of each front shielding member forms a slit therein, each front arm of the side walls of the rear shielding member forming a locking ridge thereon which is fittingly received in the corresponding slit.

12. The electrical connector assembly in accordance with claim 9, wherein each front shielding member has an upper and lower wall between the two side walls thereof and each of the upper and lower walls of each front shielding member has a rear edge extending into a recess defined by the housing in the corresponding internal space.

13. The electrical connector assembly in accordance with claim 9, wherein the side walls of the rear shielding member form board locks extending downwards therefrom.

14. The electrical connector assembly in accordance with claim 9, wherein the rear shielding member comprises an upper wall having a front edge fittingly extending into the housing.

15. An electrical connector comprising:

a dielectric housing including an upper wall, a lower wall and two side walls together defining a front face and an inner space, the housing further including a plate extending through the inner space and beyond the front face a distance, and two slots defined from two lateral sides of a rear wall of the housing to the inner space;

a plurality of contacts each having a contact portion disposed on the plate; and a front shielding member having two side walls each having a rear portion extending into the corresponding slot to engage with the housing, while remaining parts extend out of the front face of the housing to form a receiving space for generally encircling the plate.

16. The connector in accordance with claim 15, wherein the housing includes recesses to receive the rear part of the front shielding member therein.

17. The connector in accordance with claim 15, wherein the housing includes steps to latchably engage teeth of the front shielding member.

18. An electrical connector assembly, comprising:

a unitary dielectric housing composed of a number of stacked units each defining a structure substantially the same as each other, each of said units comprising an upper wall, a lower wall and two side walls together defining a front face and an inner space therein, each unit forming two slots defined from two lateral sides of a rear face thereof to the inner space, a plurality of contacts disposed within each of said units; and a corresponding number of front shielding members each defining a structure substantially the same as each other, each of the front shielding members having a rear part received within the inner space of the corresponding unit and two side walls each having a rear portion extending into the corresponding slot to engage with corresponding unit while remaining portions of each of the front shielding members forwardly extend beyond the front face of the corresponding unit so as to shield the plurality of contacts within the corresponding unit.

19. The connector assembly in accordance with claim 18, wherein one rear shielding member is attached to the housing for covering more than one units.

20. The connector assembly in accordance with claim 19, wherein said rear shielding member engages more than one front shielding members.

* * * * *